US010542343B2

(12) United States Patent
Kim et al.

(10) Patent No.: US 10,542,343 B2
(45) Date of Patent: Jan. 21, 2020

(54) PORTABLE SOUND EQUIPMENT

(71) Applicant: LG ELECTRONICS INC., Seoul (KR)

(72) Inventors: Youngil Kim, Seoul (KR); Siyoung Park, Seoul (KR); Inkwi Jang, Seoul (KR); Ehwan Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/960,007

(22) Filed: Apr. 23, 2018

(65) Prior Publication Data

US 2018/0338200 A1 Nov. 22, 2018

(30) Foreign Application Priority Data

May 16, 2017 (KR) ..... 10-2017-0060707

(51) Int. Cl.
*H04R 1/10* (2006.01)

(52) U.S. Cl.
CPC ..... *H04R 1/1066* (2013.01); *H04R 1/105* (2013.01); *H04R 1/1016* (2013.01); *H04R 2420/07* (2013.01)

(58) Field of Classification Search
CPC ..... H04R 1/1091; H04R 1/105; H04R 5/0335
USPC ..... 381/370, 371, 374, 376–381
See application file for complete search history.

(56) References Cited

U.S. PATENT DOCUMENTS 4,993,065 A * 2/1991 Chiou ..... H04M 1/05 379/430
2003/0091209 A1* 5/2003 Ito ..... H04R 5/0335 381/379
2010/0112858 A1* 5/2010 Takayama ..... H01R 4/20 439/585
2013/0004011 A1* 1/2013 Hayashida ..... H04R 1/1016 381/380
2014/0313688 A1* 10/2014 Colahan ..... B29C 70/882 361/818
2016/0295314 A1 10/2016 Jaques et al.
2017/0042270 A1* 2/2017 Chiang ..... A42B 1/245
2018/0218807 A1* 8/2018 Takahashi ..... B60R 16/0207

FOREIGN PATENT DOCUMENTS

KR 10-2016-0119722 A 10/2016
KR 10-2016-0147687 A 12/2016

* cited by examiner

*Primary Examiner* — Alexander Krzystan
(74) *Attorney, Agent, or Firm* — Birch, Stewart, Kolasch & Birch, LLP

(57) ABSTRACT

A portable sound equipment having a neckband wire unit which forms a gentle curve; a main body which is provided in each end of the neckband wire unit; a frame wire which forms a shape of the gentle curve; a sheath tube which defines an exterior appearance of the neckband wire unit cover the frame wire by covering the frame wire and exposes an end area of the frame wire; a fixing tube which covers a predetermined exposed area of the frame wire and an end area of the sheath tube; and a clamp which is configured to tighten an outer circumferential surface of the overlapped area between the sheath tube and the fixing tube is provided.

20 Claims, 11 Drawing Sheets

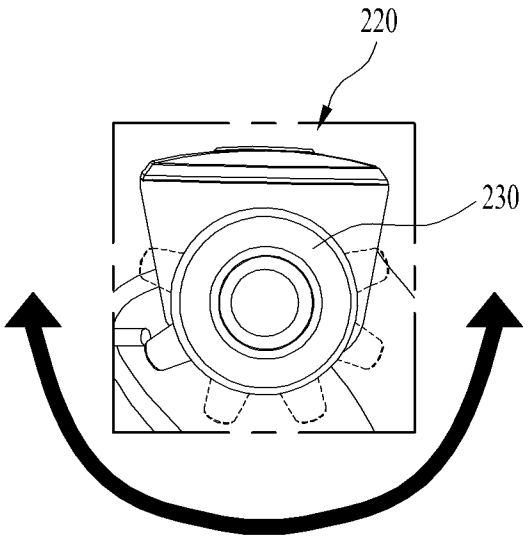
FIG. 8
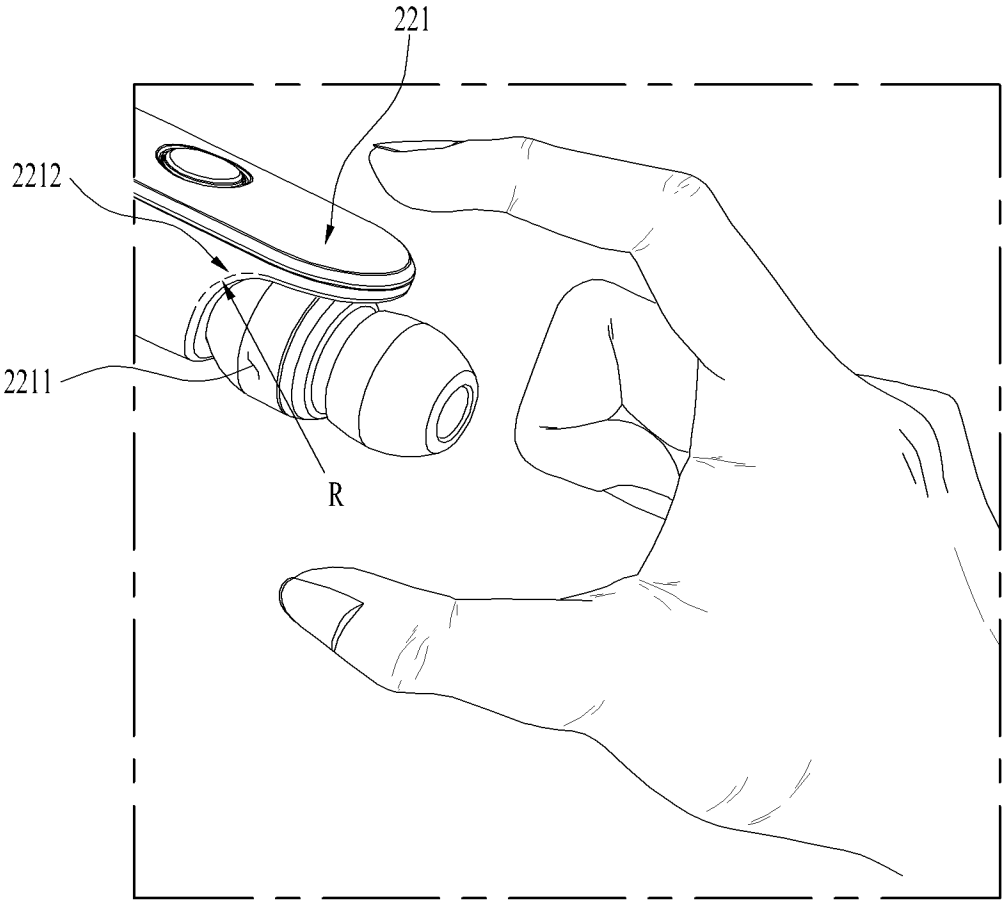

PORTABLE SOUND EQUIPMENT

CROSS-REFERENCE TO RELATED APPLICATIONS

This application claims priority to Korean Patent Application No. 10-2017-0060707, filed on May 16, 2017 in Korea, the entire contents of which is hereby incorporated by reference in its entirety.

BACKGROUND OF THE DISCLOSURE

Field of the Disclosure

Embodiments of the present disclosure relate to a portable sound equipment which may transceive an audio signal with a terminal via wire or wirelessly and control the terminal based on the signal input via a user input unit.

Background of the Disclosure

A portable sound equipment usually carried by a user may include a neckband type portable sound equipment which is useable in a state of being worn on a user's neck.

Such a neckband type portable sound equipment has to have a sufficient size to be rested around the user's neck so that it might occupy some space for being held in the hand or a predetermined bag when not used.

Accordingly, there are needs for modifying the neckband type portable sound equipment into an easily-portable type when it is not used.

Embodiments of the present disclosure suggest a neckband type portable sound equipment which is deformable for maintenance by rolling a neckband wire unit.

Moreover, when the neckband type portable sound equipment is deformed, stress will be generated in the neckband wire unit and such stress might be the factor which weakens the coupling between the neckband wire unit and a main body. Accordingly, a structure configured to stabilize the coupling between the main body and the neckband wire unit will be suggested hereinafter. Such a technical feature is the advantage applied not only to the neckband type portable sound equipment but also a conventional sound equipment to stabilize the reliability of the coupling.

In addition, the portable sound equipment is more likely to be exposed to the wearer's sweat, considering that it is a wearable device which is worn on the user's body part. Accordingly, there are needs for realizing a waterproof structure configured to minimize the possibility that such liquid will permeate into the portable sound equipment to damage internal electronic components.

A portable sound equipment including a physical button configured to a gap which inevitably allows liquid to permeate into an electric control unit may require such a waterproof structure.

Also, the neckband type portable sound equipment may include a plurality of buttons which are adjacent to each other. when the user uses the neckband type portable sound equipment, it is not easy for the user to check and use the plurality of the buttons with naked eyes and such the neighboring buttons need to be recognized properly or distinguished from each other by a tactile method Hereinafter, a neckband type portable sound equipment which may solve and satisfy the problems and needs noted above will be described.

SUMMARY OF THE DISCLOSURE

Accordingly, an object of the present invention is to address the above-noted of the portability and durability possessed by the conventional portable sound equipment and other problems.

Embodiments of the present disclosure provide a portable sound equipment comprising: a neckband wire unit which forms a gentle curve; a main body which is provided in each end of the neckband wire unit; a frame wire which forms a shape of the gentle curve; a sheath tube which defines an exterior appearance of the neckband wire unit cover the frame wire by covering the frame wire and exposes an end area of the frame wire; a fixing tube which covers a predetermined exposed area of the frame wire and an end area of the sheath tube; and a clamp which is configured to tighten an outer circumferential surface of the overlapped area between the sheath tube and the fixing tube.

The portable sound equipment may further comprise a cover bracket which covers each predetermined area of the sheath tube and the fixing tube where the clamp is provided; and a securing bellows or multi-folded insert insert-injection-molded to the cover bracket to secure the frame wire and disposed in the main body.

The fixing tube may be a heat-shrink tube.

The frame wire may comprise a shape-memory alloy and a diameter which is 0.9 mm or less.

The portable sound equipment may further comprise a seating portion recessed from one end of the main body and configured to form a seating area of an ear unit; and a loop portion extended from the end of the main body and configured to cover a predetermined upper area of the seated ear unit, wherein the loop portion forms a semi-circular shape with a preset curvature.

The seating portion may open both side areas of the seated ear unit.

Embodiments of the present disclosure may also provide a portable sound equipment comprising: a neckband wire unit which forms a gentle curve; a main body which is provided in each end of the neckband wire unit; a user input unit comprising a pair of buttons which are provided in one surface of the main body, spaced a preset distance apart from each other, wherein the user input unit comprises a pair of pressing portions which are exposed to the surface of the main body; a pair of supporting portions configured to be hooked to an inner surface of the main body by forming outer rims of the pressing portions; and a connecting bridge configured to connect outer surfaces of the supporting portions with each other.

The supporting portion may comprise an outer area; and an inner area provided in the outer area and configured to form a step recessed with respect to the outer area, and the main body may comprise a projected end which supports the inner area of the supporting portion; and a recessed end formed in a corresponding shape to the outer area of the supporting portion.

The portable sound equipment may further comprise a microphone provided between the two buttons.

The main body may comprise a first surface in which the pair of the pressing portions are provided; and a second surface which forms a step with respect to the first surface, and a first distance is formed from one of the pressing portions provided in the second surface to the second surface and a second distance is formed from the other one to the end of the main body.

According to the embodiments of the present disclosure, the portable sound equipment may have following effects.

The portable sound equipment is capable of preventing the falling out of the sheath tube.

Furthermore, the portable sound equipment may be kept and maintained in a state of being wound or rolled.

Still further, the portable sound equipment may have the ear unit which may be kept and maintained in the seating portion.

Still further, the portable sound equipment may have the ear unit which is easily detachable.

Still further, the portable sound equipment is capable of lowering the manufacturing cost of the button.

Still further, the portable sound equipment may not deteriorate the sensation of button clicking even with the lowered manufacturing cost of the button.

Still further, the portable sound equipment is capable of minimizing the probability that foreign substances will permeate into the button.

Still further, the portable sound equipment is capable of maximizing the space use by the arrangement of the electronic components.

Still further, the portable sound equipment may allow the user to find the location of the button only with the tactile sensation.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

FIG. 8 is a diagram illustrating one area of the portable sound equipment;

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
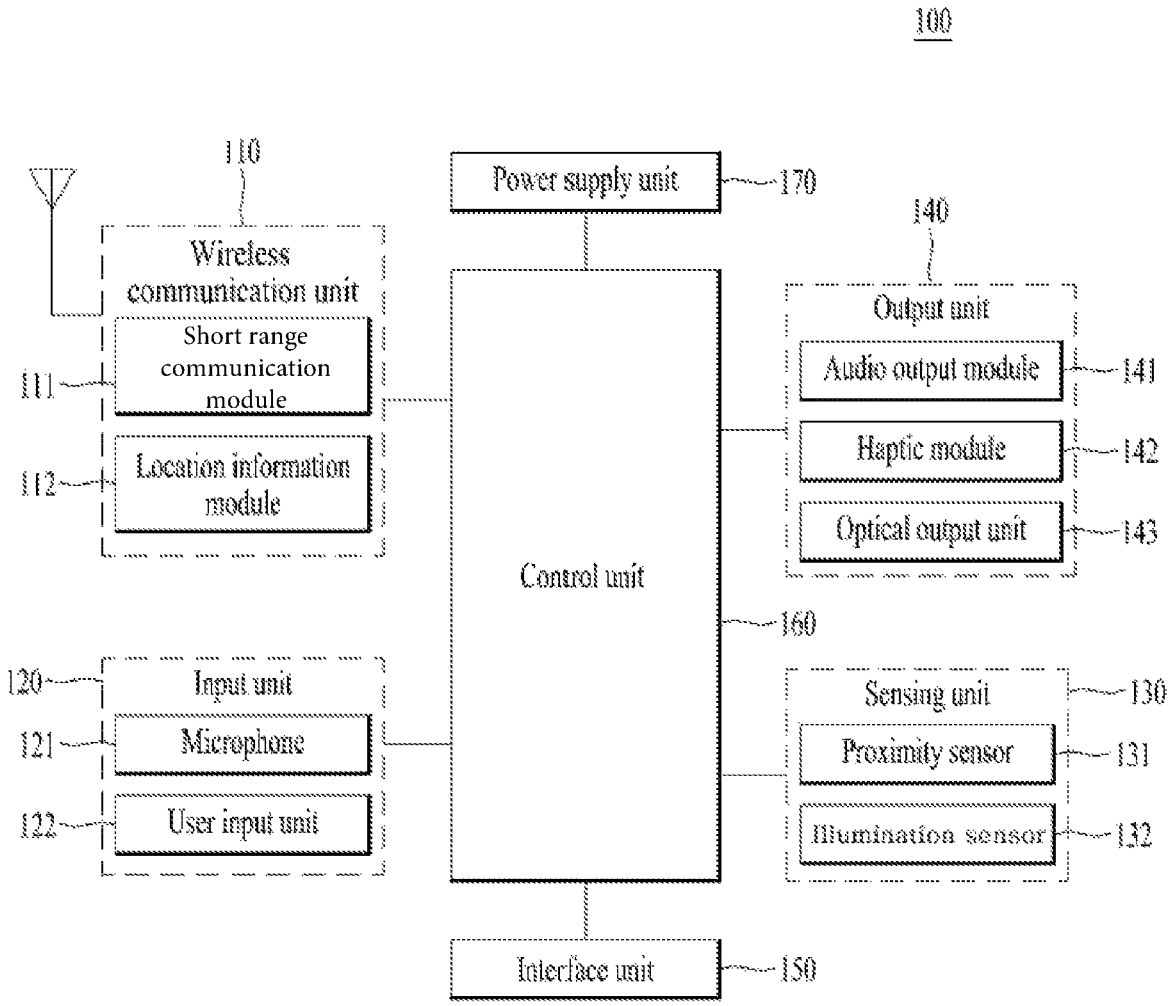
FIG. 1 is a block diagram of a portable sound equipment in accordance with the present disclosure.

FIG. 1 is a block diagram of a portable sound equipment 100 in accordance with the present disclosure.

The portable sound equipment 100 may include a wireless communication unit 110, an input unit 120, a sensing unit 130, an output unit 140, an interface unit 150, a control unit 160 and a power supply unit 170.

The elements shown in FIG. 1 are not necessary to realize the portable sound equipment. The portable sound equipment described herein may include more or less of the elements.

More specifically, the wireless communication unit 110 of the elements may include one or more modules for facilitating wireless communication between the portable sound equipment 100 and a wireless communication system, another mobile terminal or an external server. The wireless communication unit 110 may include one or more modules for connecting the portable sound equipment 100 to one or more networks.

Such the wireless communication unit 110 may include at least one of a short range communication module 111 and a location information module 112. The wireless communication unit 110 may include a mobile communication module or a wireless internet module as occasion occurs.

The short range communication module 111 is for short range communication and it may support the short range communication module by using one of Bluetooth™ RFID (Radio Frequency Identification), IrDA (Infrared Data Association), UWB (Ultra Wideband), ZigBee, NFC (Near Field Communication), Wi-Fi (Wireless-Fidelity), Wi-Fi Direct and Wireless USB (Wireless Universal Serial Bus) techniques.

Such the short range communication module 111 may support wireless communication between the portable sound equipment 100 and a wireless communication system, another mobile terminal or a network in which another mobile terminal (or an external server) is located. The short range communication networks may be wireless personal area networks.

The short range communication module 111 may be configured to sense or recognize a communicable terminal which is located near the portable sound equipment 100. In case the sensed terminal is the one authenticated to communicate with the portable sound equipment 100, the controller 160 may receive some of the data processed in the mobile terminal through the short range communication module 111. Accordingly, the user of the portable sound equipment 100 is able to use the data processed in the terminal through the wearable device.

For example, when there is a call received in the terminal, the user is able to answer a call or tall by using the portable sound equipment 100.

The location information module 112 is the module for acquiring the location or present location of the portable sound equipment 100. Typical examples of the location information module 112 include GPS (Global Positioning System) and Wi-Fi (Wireless Fidelity). As one example, the mobile terminal using a GPS module is capable of acquiring the location of the portable sound equipment 100 based on a signal transmitted from a GPS satellite. As another example, the portable sound equipment 100 using Wi-Fi is capable of acquiring the location of the portable sound equipment 100 based on information of AP (Wireless Access Point) configured to transceive a wireless signal with the Wi-Fi module. If necessary, the location information module 112 may additionally perform a function of another module provided in the wireless communication unit 110 to gain data about the location of the portable sound equipment 100. The location information module 115 is the module used in acquiring the location or present location of the portable sound equipment 100, not limited to the module for directly calculating or acquiring the location of the portable sound equipment 100.

The input unit 120 may include a microphone 121 an audio input unit for inputting an audio signal and a user input unit 122 for receiving input information from the user (for example, a touch key, a mechanical key and the like). The voice or image data collected in the input unit 120 is analyzed and processed into the user's control command.

The user input unit 122 is configured for the user to control the portable sound equipment 100. Examples of the user input unit 122 include a call button, a button for adjusting a volume, a power button and a storage button for storing an audio cable in a main body.

The user input unit 122 may include only the call button and the pair of the volume adjustment buttons or further include a play/stop button and a playlist change button rather than them.

The size of the portable sound equipment 100 is restricted and users are likely to perform inputs, not looking at the user input unit 122. If too many buttons are provided, it becomes difficult to distinguish each function of the buttons from each other. Accordingly, the time and frequency of button pressings and inputtable control commands may be expanded by using the limited number of the buttons and the combination of the buttons.

The microphone 121 processes an audio signal input from an external device into electric voice data. The processed voice data may be used based on the function performed in the portable sound equipment 100 (or the application program implemented in the portable sound equipment) or transmitted to the external terminal or server via the wireless communication unit 110. Various noise removal algorithms can be realized in the microphone to remove the noise generated while external audio signal is input.

The sensing unit 130 may include one or more sensors for sensing at least one of user information and peripheral information near the portable sound equipment. Examples of the sensing unit 130 may include one or more of a proximity sensor 131, an illumination sensor 132, a touch sensor, an acceleration sensor, a magnetic sensor, a G-sensor, a gyroscope sensor, a motion sensor, a RGB sensor, an IR sensor (Infrared sensor), a finger scan sensor, a ultrasonic sensor, an optical sensor, a microphone 121, a battery gauge, an environment sensor (e.g., a barometer, a hygroscope, a thermometer, a radiation detection sensor, a thermal sensor, a gas sensor and the like) and a chemical sensor (e.g., an electronic nose, a health care sensor, a biometric sensor and the like). Meanwhile, the portable sound equipment in accordance with the present disclosure may use combination of the information data sensed by at least two sensors.

Especially, a sensor unit may be provided to sense presence of an earphone at a holder and the magnetic sensor may be used as a typical example of such a sensor.

The output unit 140 is configured to generate outputs which are related with sight, heating and touch. The output unit 140 may include at least one of an audio output unit 141, a haptic module 142 and an optical output unit 143.

The audio output unit 141 is a device configured to output sounds based on an audio signal. Examples of the audio output unit 141 include an earphone configured to be inserted in the user's ears and transmit sounds and a speaker configured to output sounds while the user is not wearing the earphone.

The interface unit 150 functions as a passage to diverse types of external devices which are connected with the portable sound equipment 100. Such the interface unit 150 may include at least one of an external charger port and a wired/wireless data port. The portable equipment 100 may perform a proper control which is related with the connected external device(s), corresponding to the external device(s) connected with the interface unit 150.

The controller 160 is implemented to control overall operations of the portable sound equipment 100 as well as operations which are related with the application programs. The controller 260 may process signal, data information the input or output via the elements mentioned above.

Under the control of the controller 160, the power supply unit 170 is configured to supply the external electric power and internal power applied thereto to each of the elements provided in the portable equipment 100. Such the power supply unit 170 includes a battery and the battery may be an internal battery or exchangeable battery.

A predetermined number of the elements may be cooperative to realize control and execution or a control method of the portable sound equipment in accordance with diverse embodiments which will be described hereinafter.

Figure 2:
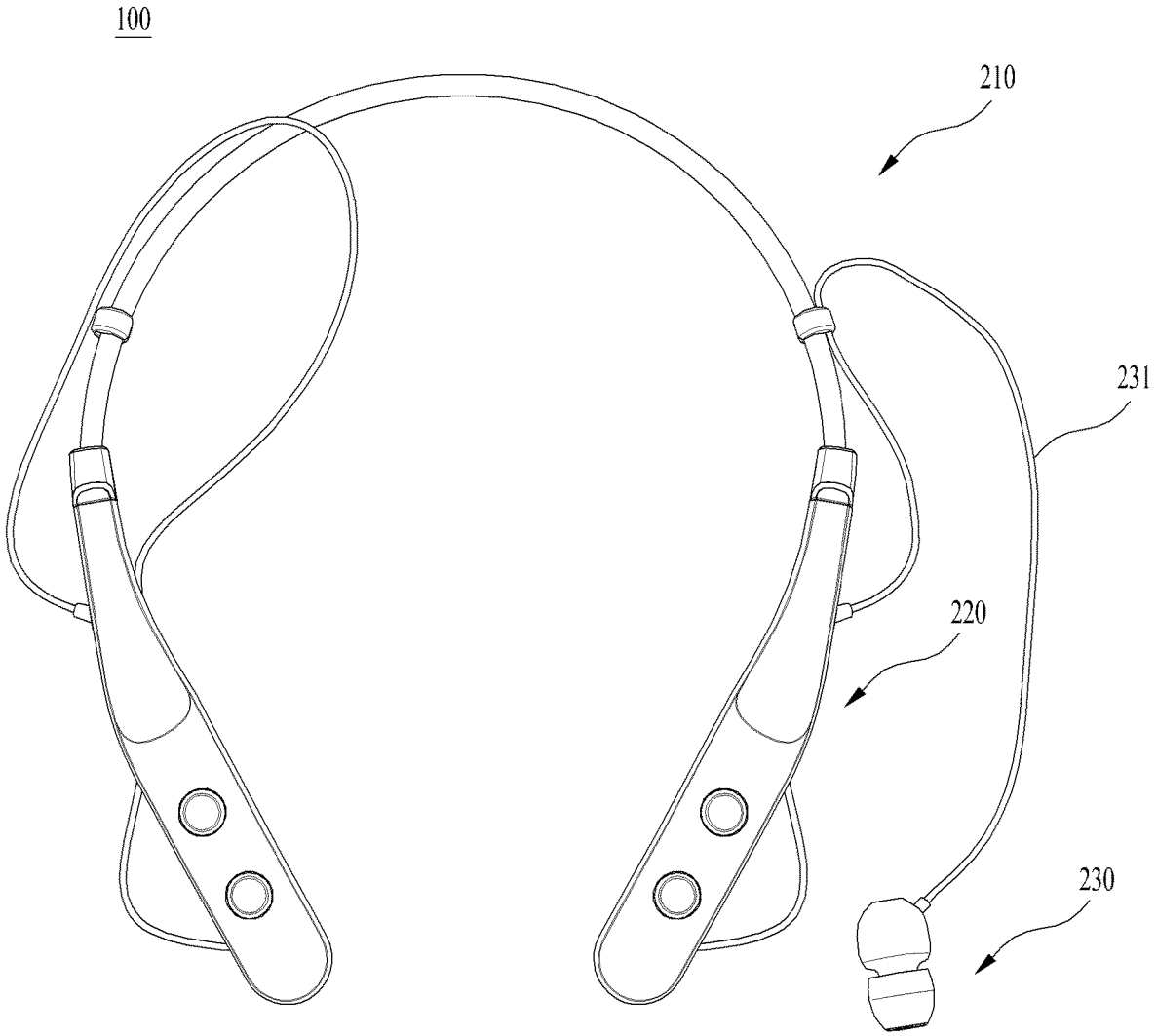
FIG. 2 is a front perspective diagram of the portable sound equipment.

FIG. 2 is a front perspective view illustrating the portable sound equipment 100.

The portable sound equipment 100 may simply include a neck-band wire 210 and a main body 220 and an ear unit 230.

For easy and convenient explanation sake, the direction in which the user wearing the portable sound equipment 100 see the ground is defined as a downward direction and the reverse direction is defined as an upward direction. The direction of the user's front view is defined as a forward direction and the reserve direction is defined as a rearward direction and a right-and-left direction is defined as a lateral or horizontal direction.

The neckband wire 210 is configured to wrap around a predetermined area of the user's neck. The main body 220 is coupled to both ends of the neckband wire 210. The overall appearance of the neckband wire 210, the main body 220 and the ear unit 230 may look like a bilateral symmetry.

The coupling between neckband wire 210 and the main body 220 has one open side to dispose the portable sound equipment 100 on the user's neck stably.

The neckband wire 210 has a restoring force to widen and narrow the portable sound equipment 100 so as to allow it to be worn on the user's neck.

An electric control unit is formed in each of the main bodies 220 and electronic components for driving the portable sound equipment 100 are loaded in the electric control units. The electronic key components such as a battery, a printed circuit board and the like.

The ear unit 230 has a drive unit loaded therein and the drive unit is configured to directly output sounds. The ear unit 230 may be electrically connected with the electronic components of the main body 220 via an ear unit wire 231.

The ear unit wire 131 is configured to electrically connect the ear unit 230 with the electronic components of the main bodies 220 or be pulled out from the main body 120 when the user uses the ear unit 230 and pushed into the main body when not using the ear unit 230.

The ear unit 230 may be detached from seating portions of the main bodies 220 to be worn on the user's ear in use and seated in the seating portion to be kept and maintained.

Figure 3:
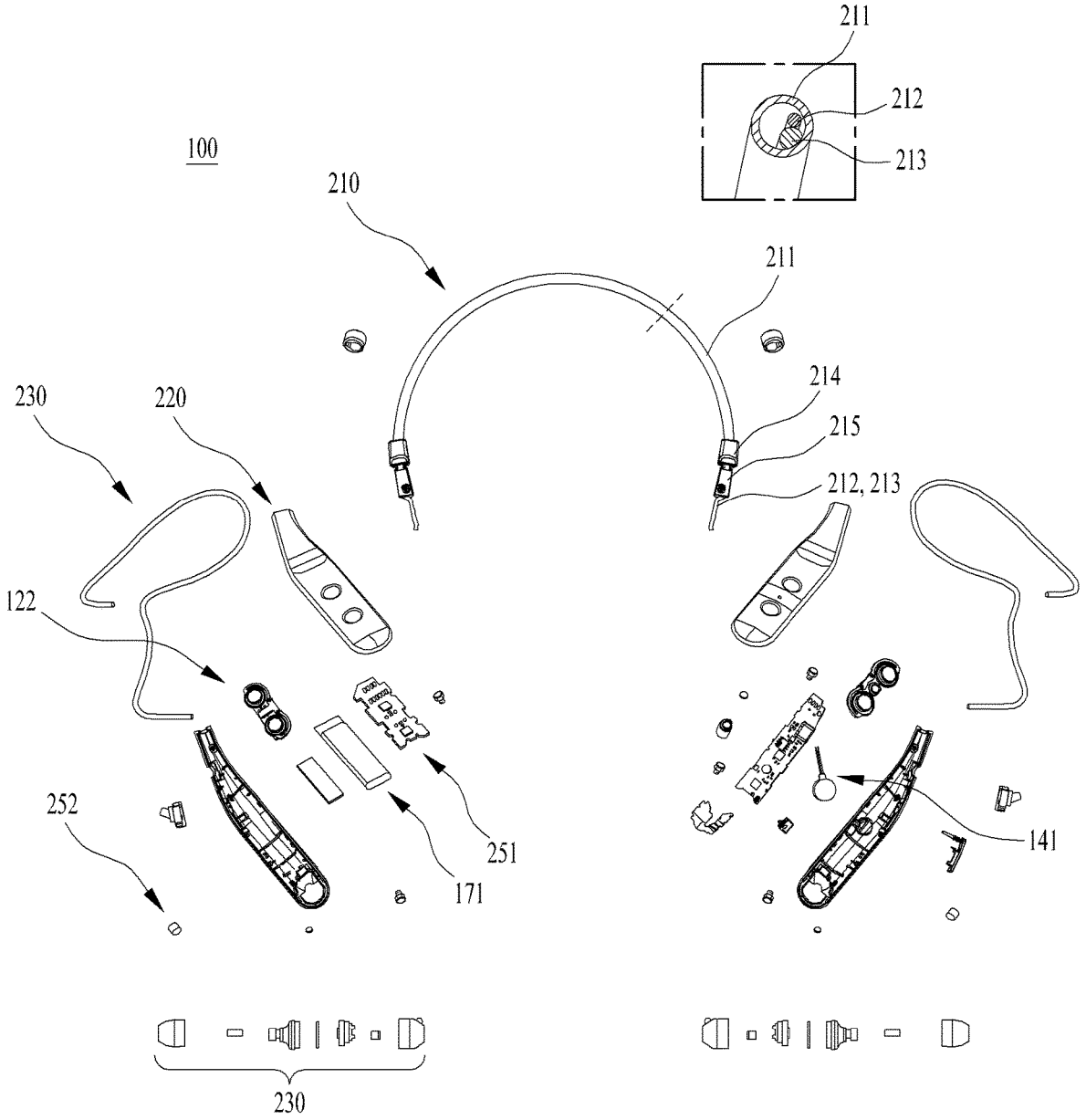
FIG. 3 is a diagram illustrating one embodiment of the portable sound equipment.

FIG. 3 is a diagram illustrating one embodiment of the portable sound equipment 220 in accordance with the present disclosure.

The neckband wire unit 210 may form a gentle curve to connecting the main bodies 220.

The neckband wire unit 210 is employed to be rested on the user's neck, in a corresponding shape to the user's neck, in a wearing aspect of the portable sound equipment 100, and to electrically connect the electronic components loaded in the two electric control units of the main bodies 220 with each other, in an audio-function execution aspect of the portable sound equipment 100.

The former one of the two functions may be mainly performed by a frame wire 212 and the latter one may be performed by a connection leading wire 213.

A sheath tube 211 is provided to cover the frame wire 212 and the connection leading wire 213 and define the exterior appearance of the neckband wire unit 210. As occasion occurs, the sheath tube 211 the sheath tube 211 may initially cover the frame wire 212 and the connection leading wire 213 and an auxiliary case may secondarily define the final exterior.

The sheath tube 211 may secure the frame wire 212 and the connection leading wire 213 not to be moving by covering them in a state of directly contacting with at least predetermined areas of the frame wire 212 and the connection leading wire 213.

To realize the functions, the sheath tube 211 may be made of a flexible material and it may have elasticity so that the sheath tube 211 extended by the insertion of the frame wire 212 and the connection leading wire 213 can shrink to secure them. Examples of the material which can satisfy such characteristics of the sheath tube 211 may include rubber.

The sheath tube 211 may cover central areas of the frame wire 212 and the connection leading wire 213, except each two end areas, but not all areas of the frame wire 212 and the connection leading wire 213.

Both ends of the frame wire 212 and the connection leading wire 213 exposed from the sheath tube 211 may be partially mounted in the main body 220 or a cover bracket 214.

The cover bracket 214 may define the exterior appearance near the connecting area between the main bodies 220 and the neckband wire unit 210. The cover bracket 214 may be configured to cover the inside of the frame wire 212 or the connection leading wire 213 from being exposed outside the portable sound equipment 100 and provide the neckband wire unit 210 with a strong object for being coupled to the main bodies 220. A securing bellows or multi-folded insert, which will be described in detail later, is provided in the strong cover bracket 214 to secure the neckband wire 210 to the main bodies 220.

The securing bellows or multi-folded insert 215 is partially seated in the main body 220 to fixedly connect the neckband wire unit 210 to the main body 220.

To secure the connection between the frame wire 212 and the sheath tube 211, a clamp 217 may be provided in an outer circumferential surface of the sheath tube 211. The clamp 217 has the frame wire 212 embedded therein and holds a predetermined outer circumferential surface area of the sheath tube 211 so as to prevent the sheath tube 211 from falling out or getting loose from the frame wire 212.

However, even with the clamp 217, the connection between the sheath tube 211 and the frame wire 212 is likely to become loose or the fixing tube 216 is likely to fall out from the frame wire 212. If the sheath tube 211 falls out, the frame wire 212 or the connection leading wire 213 might be exposed outside the portable sound equipment 100 disadvantageously.

Accordingly, a coupling structure for stabilizing the connection between the frame wire and the sheath tube 211 is required.

Figure 4:
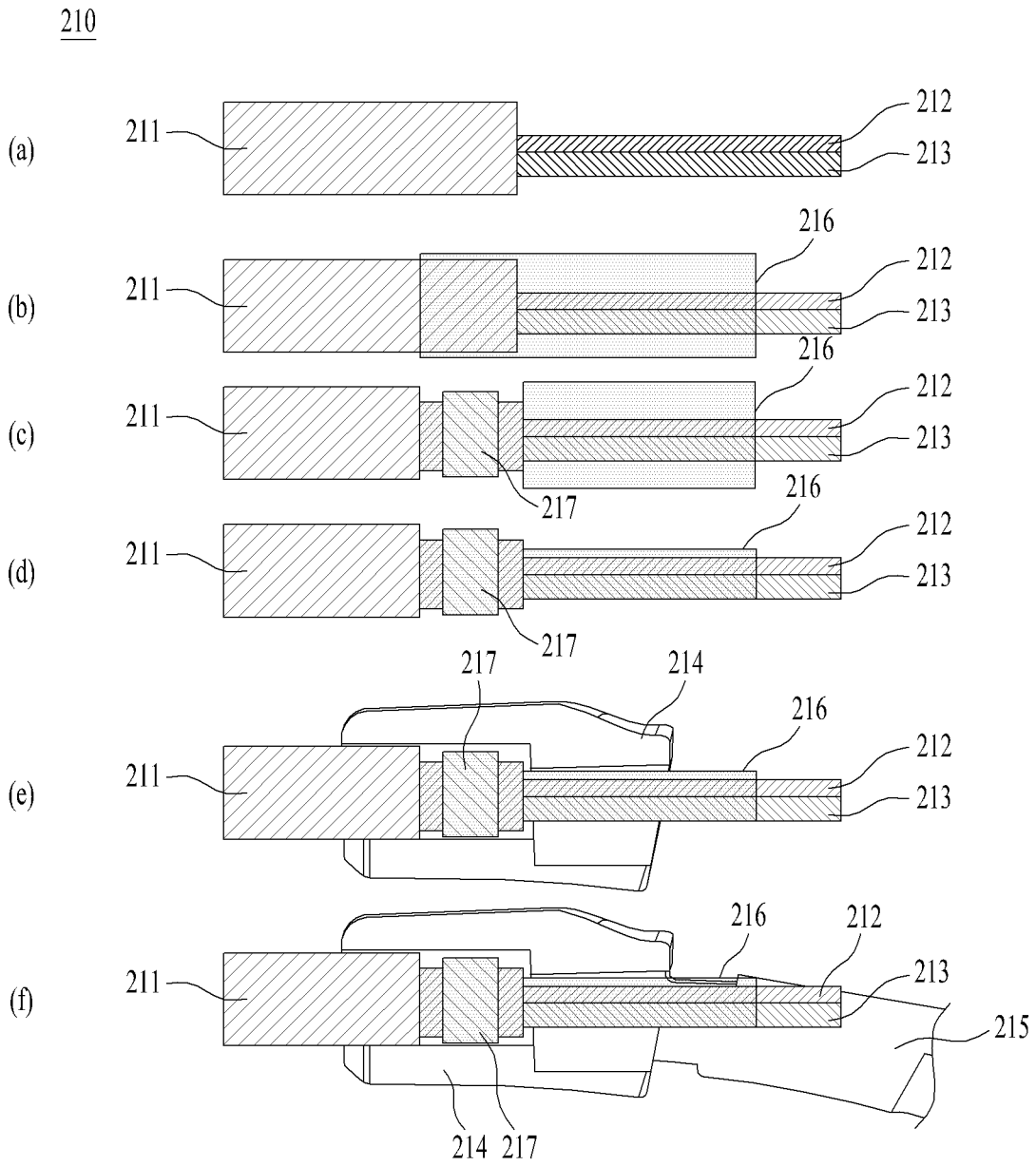
FIG. 4 is a diagram sequentially illustrating a structure configured to fix a frame wire and a conducting wire.

FIG. 4 is a diagram sequentially illustrating a structure configured to fix the frame wire 212 and the connection leading wire 213.

Referring to FIG. 4 (*a*), the frame wire 212 and the connection leading wire 213 are covered in the sheath tube 211 to have ends exposed outside.

Referring to FIG. 4 (*b*), the fixing tube 216 may cover at least predetermined areas of the exposed ends of the frame wire 212 and the connection leading wire 213. At the same time, the fixing tube 216 may cover the predetermined area of the end area of the sheath tube 211. In other words, the fixing tube 216 may cover from the end area of the sheath tube 211 to the predetermined area of the frame wire 212 and the connection leading wire 213.

The fixing tube 216 may shrink to fix from the end area of the sheath tube 211 to the predetermined areas of the frame wire 212 and the connection leading wire 213. That is, the sheath tube 211 may initially secure the frame wire 212 and the connection leading wire 213 by using the flexibility or elasticity. The fixing tube 216 may hold to secondarily fix the sheath tube 211, the frame wire 212 and the connection leading wire 213.

Referring to FIG. 4 (*c*), the clamp 217 may tighten an outer circumferential surface of the overlapped area between the sheath tube 211 and the fixing tube 216.

The clamp 217 may be formed in a 'C' shape like a clip to thirdly fix the sheath tube 211 and the fixing tube 216 or in a spiral shape like a coil to fix them.

The clamp 217 has to have a sufficient strength to keep the fixed state so that it may be made of metal.

Referring to FIG. 4 (*d*), the fixing tube 216 may shrink to fix the components having the areas corresponding to the contacted area. In other words, the fixing tube 216 may prevent the sheath tube 2111 from easily falling out from the frame wire 212 and the connection leading wire 213 by fixing the sheath tube 211, the frame wire 212 and the connection leading wire 213.

The fixing tube 216 may be a heat-shrink tube which is shrinkable by heat. Such a heat-shrink tube may be shrinkable by a heater.

Referring to FIG. 4 (*e*), the cover bracket 214 may cover a predetermined area which includes one end of the sheath tube 211 and some area of the fixing tube 216. Especially, the cover bracket 214 may cover each area of the sheath tube 211 and the fixing tube 216 where the clamp 217 is provided. The cover bracket 214 may be employed to prevent the clamp 217 and the fixing tube 216 from being exposed outside the portable sound equipment 100.

The cover bracket 214 may define a proper space for loading the components mentioned above. The cover bracket 214 may be insertedly fitted into the neckband wire unit 210 in a state of FIG. 4 (*d*). on the assumption that the securing bellows or multi-folded insert, which will be described later, is insert-injection-molded, the cover bracket 214 need not fix the neckband wire unit 210 in the state of FIG. 4 (*d*) strongly.

Referring to FIG. 4 (*f*), the securing bellows or multi-folded insert 215 may be configured to secure at least two components to each other and seat the secured components in the main bodies 220 to couple the secured components to the main bodies 220.

The components secured by the securing bellows or multi-folded insert 215 may include at least two of the fixing tube 216, the frame wire 212, the connection leading wire 213 and the cover bracket 214.

Especially, the securing bellows or multi-folded insert 215 is insert-injection molded in an inner surface of the cover bracket 214 to integrally secure the cover bracket 214, the fixing tube 216, the frame wire 212 and the connection leading wire 213. In this instance, the securing bellows or multi-folded insert 215 may fourthly fix the components.

Figure 5:
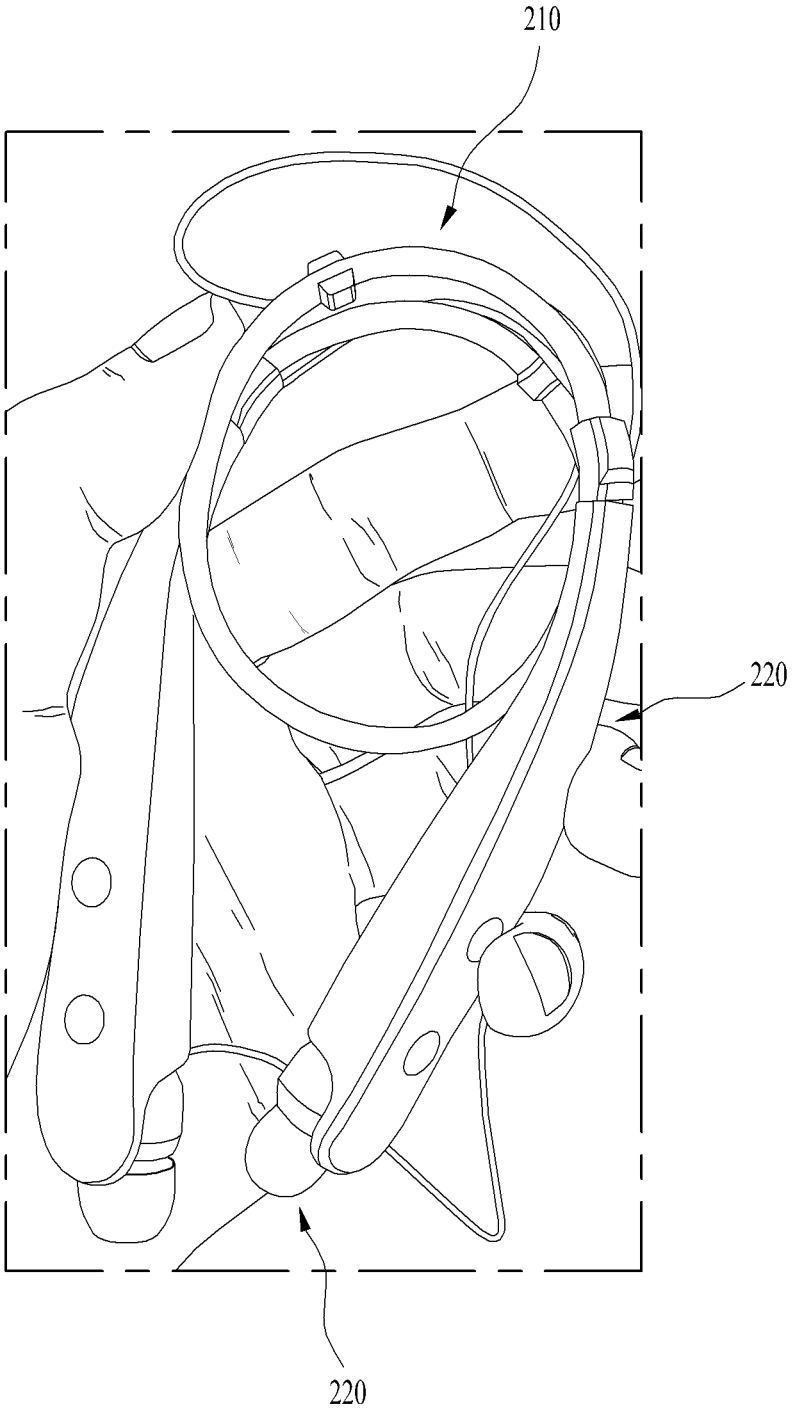
FIG. 5 is a diagram illustrating another embodiment of the portable sound equipment.

FIG. 5 is a diagram illustrating another embodiment of the portable sound equipment 100.

The frame wire 212 may be employed to keep the shape which is easily rested on the user's neck, when the user uses the portable sound equipment 100. For that, the frame wire 212 may be made of a shape-memory alloy.

The portable sound equipment may be deformed into a small size after being wound at least one time, when it is not used. The wound portable sound equipment 100 may be kept in a pocket or the like.

The winding area may be the neckband wire unit 210. The main bodies 220 need a preset rigidity or more to protect the electric control unit so that the neckband wire unit 210 may be wound.

A diameter of the frame wire 212 may be 0.9 mm for the user to wind the neckband wire unit 210 with a proper force. When the diameter is more than 0.9 mm, it requires a strong force to wind the neckband wire unit 210 according to experiments. When the diameter is less than 0.9 mm, it is impossible to keep the preset rigidity when the user uses the portable sound equipment 100 and then difficult to wear or rest it on the user's neck. Accordingly, it is preferred that the diameter of the frame wire 212 is 0.9 mm.

Figure 6:
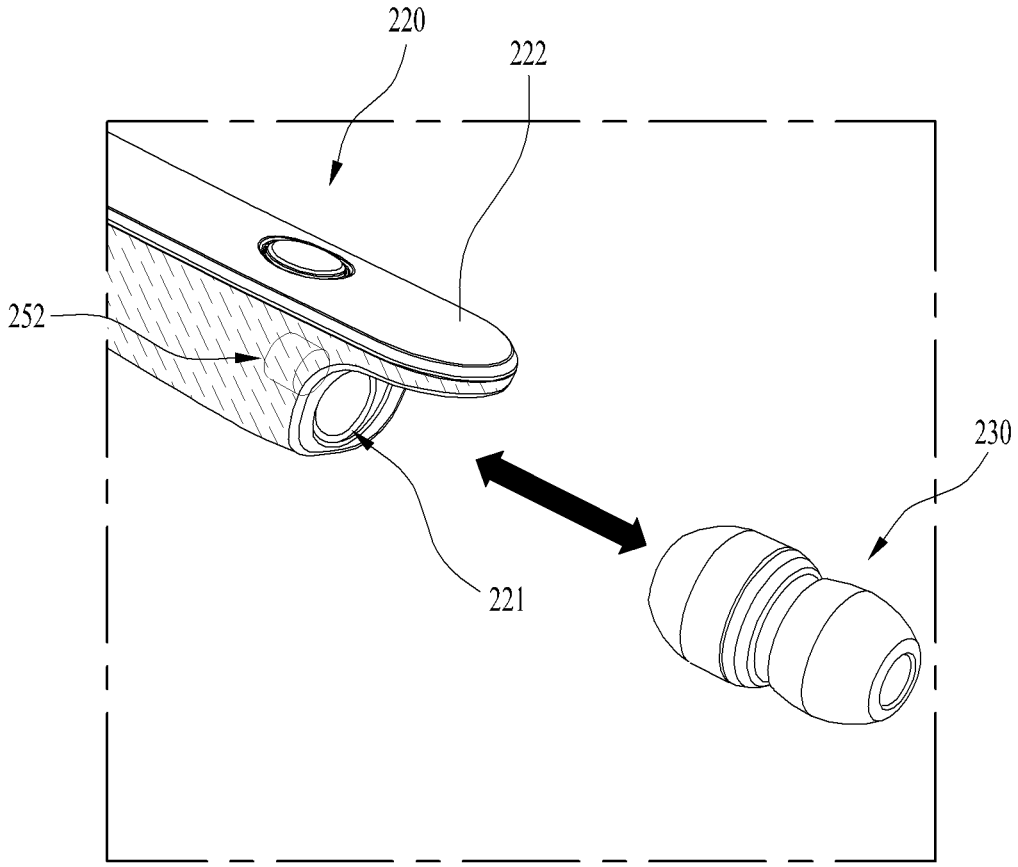
FIG. 6 is a diagram illustrating one area of the portable sound equipment.

FIG. 6 is a diagram illustrating one area of the portable sound equipment 100.

A seating portion 221 for seating the ear unit 230 may be provided in the main body 220. The seating portion 221 may be recessed from one end of the main body 220 and formed in a corresponding shape to a partial rear area of the ear unit 230 to provide a shape condition for stably seating the eat unit 230 in the seating portion.

Magnetic portions 252 for generating a mutual attraction may be provided in an inner seating surface of the seating portion 221 and an internal rear area of the ear unit 230, respectively, to provide a strength condition for easily seating the eat unit 230 on the seating portion 221, using a magnetic force.

The pair of the main bodies 220 may be provided in both ends of the portable sound equipment 100, respectively, and the seating portions 221 may be formed in the main bodies 220, respectively. It is obvious to apply the technical features which will be described later to the pair of the main bodies 220, respectively, unless otherwise specified.

Figure 7:
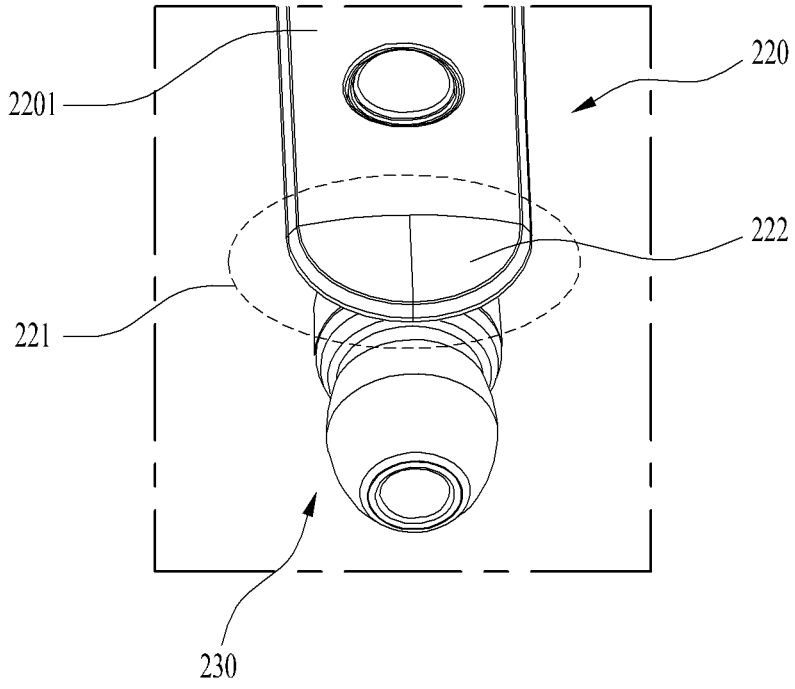
FIG. 7 is a diagram illustrating one area of the portable sound equipment.

FIG. 7 is a diagram illustrating one area of the portable sound equipment 100.

While the seating portion 221 is recessed from one end of the main body 220, a loop portion 222 is extended from the end of the main body 220 to cover a predetermined top area of the seated ear unit 230.

The loop portion 222 is employed to partially hide the eat unit 230 to prevent the entire area of the ear unit 230 from being exposed outside when the user is wearing the portable sound equipment 100. Also, the loop portion 222 may be also employed to guide the user's finger toward the eat unit 230 when the user tries to hold the seated ear unit 230 to use.

The loop portion 222 may have a semi-circular shape with a preset curvature. A semi-circular-shaped loop portion 222 makes the end of the main body 220 be curved to prevent the hooking or trapping when the user tries to hold or keep the main body 220.

The semi-circular-shaped curvature radius may be a half of the traverse length of the top surface 2201 of the main body.

FIG. 8 is a diagram illustrating one area of the portable sound equipment 100.

When the ear unit 230 is seated on the seating portion 221, the seating portion 221 has a preset shape to expose both sides of the ear unit 230. In case both side area of the ear unit 230 are exposed outside, the user is able to hold the both sides of the ear unit and detach the ear unit 230 from the seating portion 221 by two fingers easily.

Especially, the open side 2211 of the seating portion 221 may expose the half of the lateral surface of the ear unit 230 thereto so that the user can hold the ear unit 230 easily.

The probability that a cable 231 of the ear unit 230 will be trapped or hooked to the main body 220 may be lowered by the seating portion 221 having the two opposite open sides 2211. Accordingly the user can seat the eat unit 230 in several directions easily by minimizing the trapping of the cable 231.

An outer rim 2212 of the seating portion 221 is curved from the loop portion 222 to form the entire area of the loop portion 222 and the outer rim 2212 of the seating portion 221 in a streamlined shape. The streamlined shape can minimize the trapping of the cable or finger.

Figure 9:
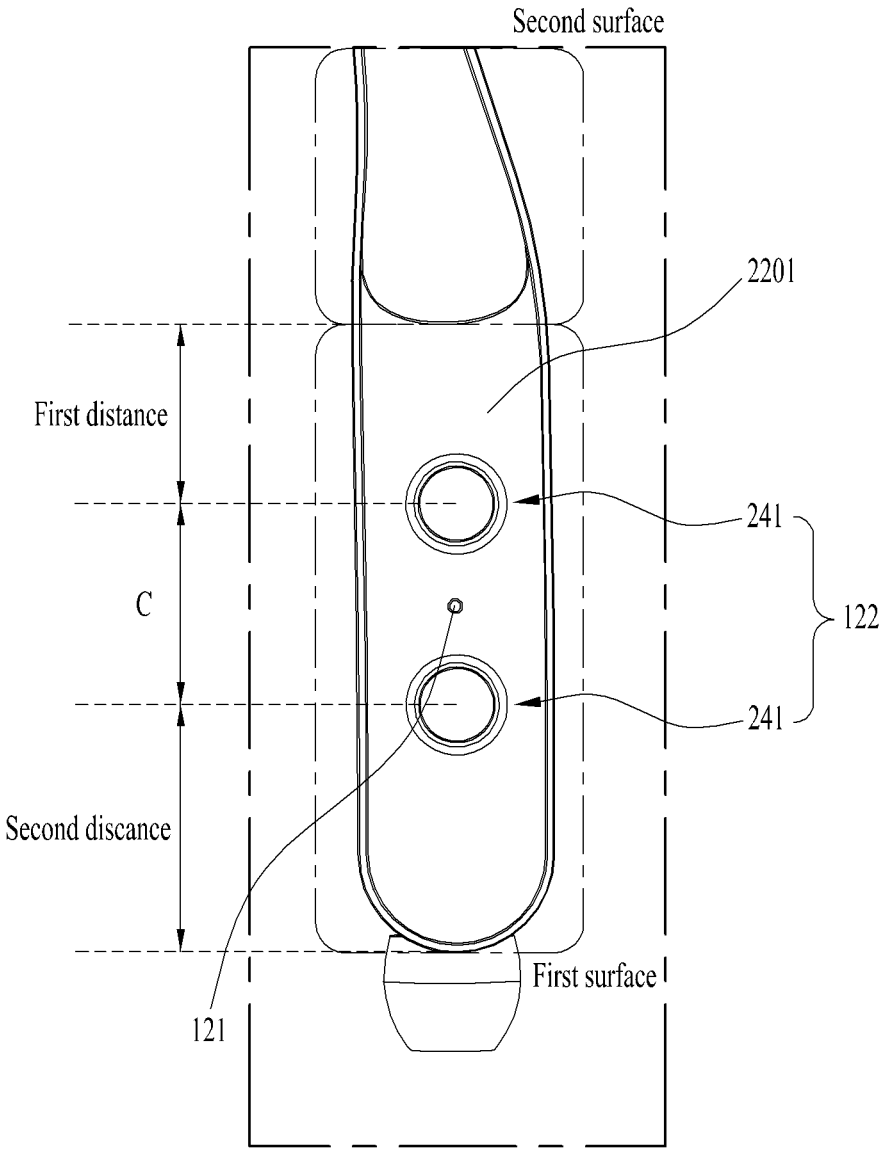
FIG. 9 is a diagram illustrating one area of the portable sound equipment.

FIG. 9 is a diagram illustrating one area of the portable sound equipment 100.

The portable sound equipment 100 may include the user input unit 122 for receiving an external input. The user input unit 122 may perform diverse functions such as power on/off, volume up/down, play/stop and the like.

The user input unit 122 may include a physical key for inputting a signal via pressing. The physical key may be a button 241 using a dome key.

Especially, the user input unit 122 may be provided as a pair of buttons 241 provided in one surface of the main body 220, more specifically, a top surface 2201 in a state of being spaced apart from each other.

Figure 10:
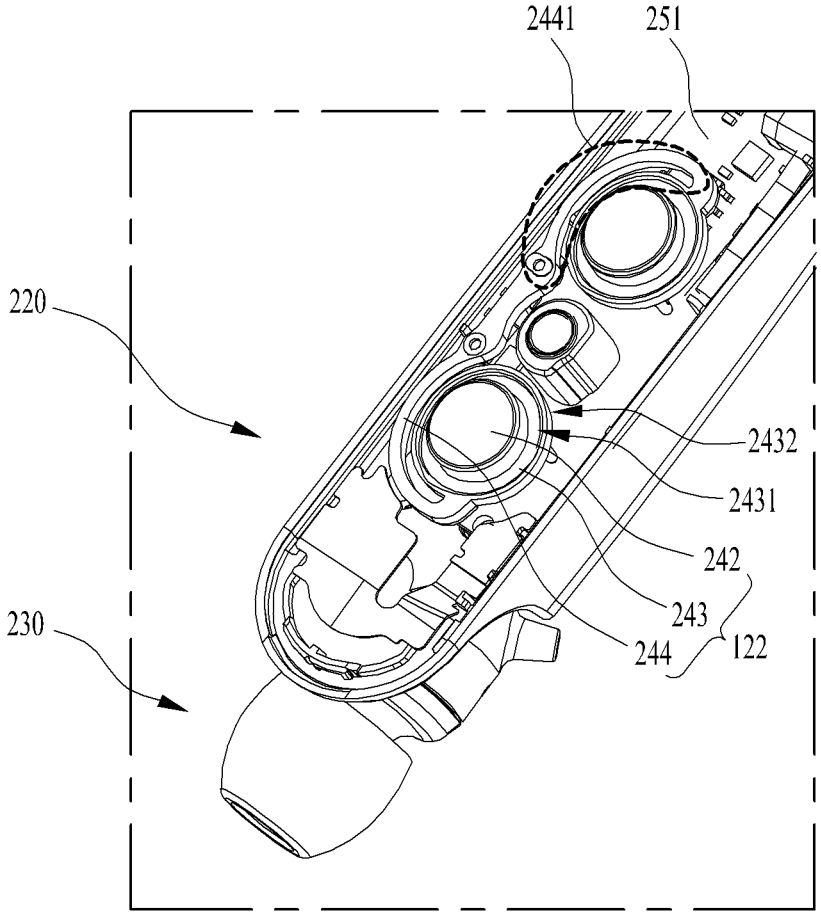
FIG. 10 is a perspective diagram illustrating a state where a top surface of a main body is removed from the portable sound equipment.

FIG. 10 is a perspective diagram illustrating a state where a top surface of the main body 220 is removed from the portable sound equipment 100.

The user input unit 122 may include a pair of pressing portions 242; a pair of supporting portions 243; and a connecting bridge 244.

The pressing portion 242 may mean the component which is exposed to one surface of the main body 220 to directly receive the user's physical input.

The supporting portion 243 may be formed in an outer rim of the pressing portion 242 and configured to be hooked to the inner surface 2204 of the main body 220 so as to prevent the user input unit 122 from escaping outwardly from the main body 220.\

The connecting bridge 244 may be configured to connect the pair of the pressing portions 242 with each other so that the two pressing portions and the two supporting portions 243 can be assembled as one module unit. The connecting bridges 244 may be directly connected to the pressing portions 242, respectively. However, it is preferred that the connecting bridge 244 connect the supporting portions 243 with each other.

The user input unit assembled as one module unit including the pair of the pressing portions 122 has an advantage of minimizing the manufacturing and assembling cost.

Especially, the connecting bridge 244 may be connected to an outer area of each supporting portion 243. That is to minimize the probability that even the other one will be unintentionally pressed by the rigidity of the entire module when one of the pressing portions 242 is pressed during the user inputting process of the user input unit 122.

In other words, the connecting bridge 244 connected to the outer area of the supporting portions 243 may minimize the probability that the force applied to one of the pressing portions 242 will be transferred to the other one.

The pressing portions 242 and the supporting portions 243 may have a circular shape and at least predetermined area of the connecting bridge 244 may include a curved area 2441 corresponding to the circular shape. The connecting bridge 244 having the curved area 2441 corresponding to the circular shape may connect the pressing portions with each other and minimize the space occupied by the connecting bridge 244 simultaneously.

The user input unit 122 may contact with the dome key provided therein to realize a dome key type physical key. The dome key may be embedded in the substrate 251 and configured to generate an electrical signal.

Figure 11:
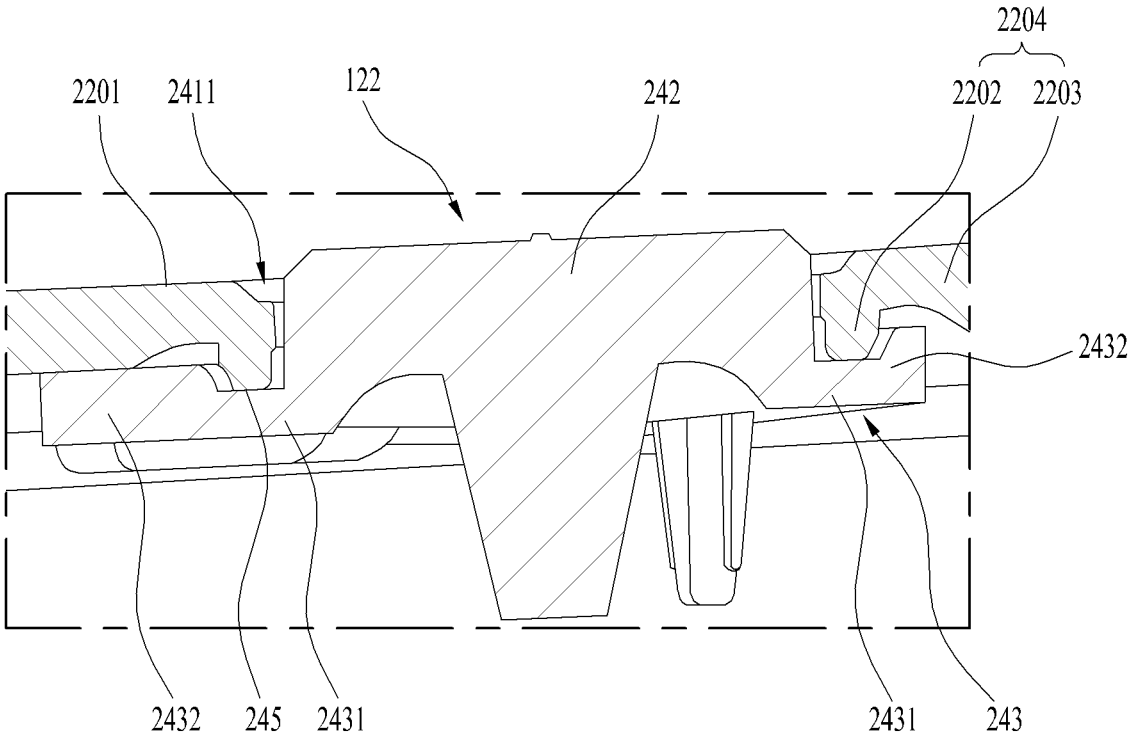
FIG. 11 is a sectional diagram illustrating a predetermined area of a user input unit provided in the portable sound equipment.

FIG. 11 is a sectional diagram illustrating a predetermined area of the user input unit 122 provided in the portable sound equipment.

The physical key type user input unit 122 may generate a gap 2411 between the pressing portions and one surface of the main body 220. Liquid might permeate into the gap 2411 to badly affect the electronic components of the electric control unit. Especially, the portable sound equipment 100 may be used in a state of being rested on the user's neck so that sweat may be more likely to flow thereon and that it may require a waterproof structure which is provided in the corresponding area.

To realize the waterproof structure, the supporting portions 243 in accordance with the present disclosure may include an outer area 2432 and an inner area 2431 provided in the outer area 2432 and forming a step recessed from a top surface of the outer area 2432.

Corresponding to the shape of such the supporting portion 243, the inner surface 2204 of the main body 220 to which the supporting portion 243 is hooked may include a projected end 2202 and a recessed end 2203. The projected end 2202 may support the inner area 2431 of the supporting portion 243 and the recessed end 2203 may be provided in a corresponding shape to the outer area 2432 of the supporting portion 243.

More specifically, while the boundary between the conventional user input unit 122 and the body may form a simply '¬'-shaped gap 2411, an inner boundary 245 between the user input unit 122 and the main body 220 in accordance with the present disclosure may form a '⊏'-shaped gap to block a passage of the liquid which might permeate.

Referring to FIG. 9 again, the pair of the buttons 241 may be spaced a preset distance apart from each other. When the buttons 241 for performing different functions, respectively, are provided adjacent to each other, an input error might occur in consideration of the characteristics of the portable sound equipment 100 in accordance with the present disclosure which allows the user to perform the user input, without checking with naked eyes.

The distance (C) between the centers of the two buttons 241 may be 15 mm-20 mm on a basis of experiments.

A microphone may be provided between the two buttons 241. That is to maximize the space use of the small-sized portable sound equipment 100 by providing the microphone between the pair of the buttons 241 which have to be inevitably spaced a preset distance apart from each other.

The top surface of the main body 220 may include a first surface and a second surface which forms a step with respect to the first surface. When the pair of the pressing portions 242 may be provided in the first surface, with the second surface which forms the step with respect to the first surface, the user may expect the location of the user input unit 122 via an outer rim of the step.

A first distance may be formed from the pressing portion 242 of the second surface in the pair of the user input units 122 to the second surface and a second distance may be formed from the other pressing portion 242 to the end of the main body 220.

The first distance and the second distance may be formed as similarly as possible so as to keep the user's sensation for finding one of the pressing portions 242 provided in the second surface from the rim of the step similar to the user's sensation for finding the other one from the end of the main body 220. Accordingly, the user is able to expect the location of each pressing portions 242 without seeing them with naked eyes.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims.

Therefore all changes and modifications that fall within the metes and bounds of the claims, or equivalents of such metes and bounds, are therefore intended to be embraced by the appended claims.

What is claimed is:

1. A portable sound equipment comprising:

a neckband having a curved shape, the neckband having two opposed ends, the neckband having:

a frame wire having the curved shape, the frame wire having two opposed ends;

a sheath tube defining an exterior appearance of the neckband, the sheath tube partially covering the frame wire such that each of the two opposed ends of the frame wire have an exposed area;

a pair of fixing tubes, each fixing tube configured to cover a predetermined portion of one of the exposed areas of the frame wire and an end area of the sheath tube adjacent the one of the exposed areas of the frame wire; and a pair of clamps, each clamp being provided around an outer circumferential surface of a corresponding one of the fixing tubes that overlaps the sheath tube;

a pair of cover brackets, each cover bracket being configured to cover the sheath tube, a corresponding one of the pair fixing tubes and a corresponding one of the pair of clamps;

a pair of securing multi-folded inserts, each of the securing multi-folded inserts being insert-injection-molded to a corresponding one of the cover brackets to secure the frame wire; and a pair of main bodies, each of the main bodies being provided at one of the two opposed ends of the neckband and each of the securing multi-folded inserts being disposed in a corresponding one of the main bodies.

2. The portable sound equipment of claim 1, wherein the fixing tube is a heat-shrinkable tube.

3. The portable sound equipment of claim 1, wherein the frame wire comprises a shape-memory alloy.

4. The portable sound equipment of claim 3, wherein the frame wire has a diameter that is 0.9 mm or less.

5. The portable sound equipment of claim 1, further comprising a pair of ear units, each ear unit being connected to a corresponding one of the main bodies.

6. The portable sound equipment of claim 5, wherein each of the main bodies includes:

a seating portion recessed from one end of the main body, the seating portion being configured to form a seating area for the ear unit; and a loop portion extended from the one end of the main body, the loop portion being configured to cover a predetermined upper area of the ear unit when the ear unit is seated on the seating portion.

7. The portable sound equipment of claim 6, wherein the loop portion has a semi-circular shape.

8. The portable sound equipment of claim 6, wherein the seating portion is configured to expose opposite sides of the ear unit when the ear unit is seated on the seating portion.

9. A portable sound equipment comprising:

a neckband having a curved shape, the neckband having two opposed ends;

a pair of main bodies, each of the main bodies being provided at one of the two opposed ends of the neckband; and an input unit provided at one surface of one of the main bodies, the input unit including:

a pair of pressing portions exposed through the one surface of the one of the main bodies;

a pair of supporting portions provide as outer rims of the pressing portions, the supporting portions being configured to hook to an inner surface of the one surface of the main body; and a connecting bridge including two ends configured to connect outer surfaces of the supporting portions.

10. The portable sound equipment of claim 9, wherein each of the supporting portions includes:

an outer area; and an inner area connected to the outer area, the inner area forming a step with respect to the outer area.

11. The portable sound equipment of claim 10, wherein the inner surface of the main body includes:

a pair of projections supporting the inner areas of the supporting portions; and a pair of recessed portions having shapes corresponding to the outer areas of the supporting portions.

12. The portable sound equipment of claim 9, further comprising a microphone provided between the pair of pressing portions of the input unit.

13. The portable sound equipment of claim 9, wherein the one surface of the main body includes:

a first surface in which the pair of the pressing portions are provided; and a second surface which forms a step with respect to the first surface, and wherein a first distance is defined between one of the pressing portions provided and the second surface and a second distance is defined between the other one of the pressing portions and the end of the first surface that is spaced from the second surface.

14. The portable sound equipment of claim 13, wherein the first distance is equal to the second distance.

15. The portable sound equipment of claim 9, wherein the neckband includes:

a frame wire having the curved shape, the frame wire having two opposed ends;

a sheath tube defining an exterior appearance of the neckband, the sheath tube partially covering the frame wire such that each of the two opposed ends of the frame wire have an exposed area;

a pair of fixing tubes, each fixing tube configured to cover a predetermined portion of one of the exposed areas of the frame wire and an end area of the sheath tube adjacent the one of the exposed areas of the frame wire; and a clamp which is configured to tighten around an outer circumferential surface of the fixing tube that overlaps the sheath tube.

16. The portable sound equipment of claim 15, wherein the fixing tube is a heat-shrinkable tube.

17. The portable sound equipment of claim 15, wherein the frame wire comprises a shape-memory alloy.

18. The portable sound equipment of claim 9, further comprising a pair of ear units, each ear unit being connected to a corresponding one of the main bodies.

19. A portable sound equipment comprising:

a neckband having a curved shape, the neckband having two opposed ends;

a pair of main bodies, each of the main bodies being provided at one of the two opposed ends of the neckband; and an input unit provided at one surface of one of the main bodies, the input unit including:

a pair of pressing portions exposed through the one surface of the one of the main bodies; and a pair of supporting portions provide as outer rims of the pressing portions, the supporting portions being configured to engage an inner surface of the main body; and wherein each of the supporting portions includes:

an outer area; and an inner area connected to the outer area, the inner area forming a step with respect to the outer area.

20. The portable sound equipment of claim 19, wherein the inner surface of the main body includes:

a pair of projections supporting the inner areas of the supporting portions; and a pair of recessed portions having shapes corresponding to the outer areas of the supporting portions.

* * * * *